US007495647B2

(12) United States Patent
Tryhub et al.

(10) Patent No.: US 7,495,647 B2
(45) Date of Patent: Feb. 24, 2009

(54) LCD BLUR REDUCTION THROUGH FRAME RATE CONTROL

(75) Inventors: John Tryhub, Mississauga (CA); Steve Selby, Scarborough (CA)

(73) Assignee: Genesis Microchip Inc., Santa Clara, CA (US)

( * ) Notice: Subject to any disclaimer, the term of this patent is extended or adjusted under 35 U.S.C. 154(b) by 719 days.

(21) Appl. No.: 11/021,635

(22) Filed: Dec. 22, 2004

(65) Prior Publication Data

US 2005/0285815 A1 Dec. 29, 2005

Related U.S. Application Data

(60) Provisional application No. 60/579,954, filed on Jun. 14, 2004, provisional application No. 60/527,423, filed on Dec. 8, 2003, provisional application No. 60/527,543, filed on Dec. 5, 2003, provisional application No. 60/527,437, filed on Dec. 5, 2003.

(51) Int. Cl.
*G09G 3/36* (2006.01)

(52) U.S. Cl. ..... 345/99; 345/87; 345/88; 345/90; 345/209; 345/211

(58) Field of Classification Search ..... 345/99, 345/87–90, 209–211
See application file for complete search history.

(56) References Cited

U.S. PATENT DOCUMENTS 6,008,790 A 12/1999 Shingu et al.
6,456,266 B1 9/2002 Iba et al.
7,072,702 B2 * 7/2006 Edgar et al. ..... 600/336
7,215,309 B2 * 5/2007 Yamato et al. ..... 345/87
2002/0015017 A1 2/2002 Kwag
2002/0015104 A1 2/2002 Itoh et al.
2003/0179221 A1 9/2003 Nitta et al.
2004/0041745 A1 3/2004 Chen

FOREIGN PATENT DOCUMENTS

WO WO 99/57706 11/1999

OTHER PUBLICATIONS

Australian Written Opinion dated Dec. 7, 2006 in corresponding Singapore Application No. 200503364-2.
European Search Report dated Jul. 4, 2008 in EP Application No. 05253483.1.
Chinese Office Action dated Mar. 21, 2008 in Chinese Application No. 200510078890.9.
Chinese Office Action dated Nov. 14, 2008 in Chinese Application No. 200510078890.9.

* cited by examiner

*Primary Examiner*—Richard Hjerpe
*Assistant Examiner*—Leonid Shapiro
(74) *Attorney, Agent, or Firm*—Beyer Law Group LLP

(57) ABSTRACT

Reducing fast motion artifacts in an LCD panel by receiving a video stream at a first frame rate which is then downsampled to a second frame rate. The downsampled video stream is then upsampled to a third frame rate and a voltage is applied to a pixel element such that the pixel element transitions from a first pixel value to a predetermined second pixel value within a period of time consistent with the third frame rate.

32 Claims, 12 Drawing Sheets

LCD BLUR REDUCTION THROUGH FRAME RATE CONTROL

RELATED APPLICATIONS

This patent application takes priority under 35 U.S.C. 119(e) to (i) U.S. Provisional Patent Application No. 60/579,954 filed on Jun. 14, 2004 entitled "LCD BLUR REDUCTION THROUGH FRAME RATE CONTROL" by Tryhub et al, (ii) U.S. Provisional Patent Application No.: 60/527,423 filed on Dec. 8, 2003 entitled "LCD OVERDRIVE AUTO-CALIBRATION" by Selby, (iii) U.S. Provisional Patent Application No.: 60/527,543 filed on Dec. 5, 2003 entitled "METHOD OF IMPROVING FIXED PIXEL DISPLAY RESPONSE TIME" by Selby, and (iv) U.S. Provisional Patent Application No.: 60/527,437 filed on Dec. 5, 2003 entitled "METHOD AND APPARATUS FOR ENHANCING THE APPEARANCE OF MOTION ON AN LCD PANEL" by Selby, each of which are incorporated by reference in its entirety.

FIELD OF THE INVENTION

The invention relates to display devices. More specifically, the invention describes a method and apparatus for enhancing the appearance of motion on an LCD panel display.

OVERVIEW

Liquid crystal displays (LCD) panels tend to produce blurred edges and "ghosting" artifacts around moving objects on the screen. One reason for this blurring is the slow response time of the liquid crystals in response to a change in pixel value. When onscreen objects move, the values of any given pixel in the area of motion will change from frame to frame. However, when an LCD with slow response is used, one frame time may not be sufficient for many pixels to change from the old value fully to the new desired value. This reduces the contrast of moving edges and hence causes blurring. Furthermore, single pixel wide or high lines never reach their intended brightness at all.

Therefore, what is desired are techniques that reduce the observed motion artifacts such as blurring in slow LCD panels.

SUMMARY OF THE DISCLOSURE

What is provided is a method, apparatus, and system suitable for implementation in Liquid Crystal Display (LCDs) that reduces a pixel element response time that enables the display of high quality fast motion images thereupon.

In a liquid crystal display device having a number of pixels, a method for A method of reducing fast motion artifacts in an LCD panel is described. The method includes the operations of receiving a video stream at a first frame rate, downsampling the video stream to a second frame rate, upsampling the downsampled video stream to a third frame rate, and applying a voltage to a pixel element such that the pixel element transitions from a first pixel value to a predetermined second pixel value within a period of time consistent with the third frame rate.

In another embodiment, computer program product for reducing fast motion artifacts in an LCD panel is disclosed. The computer program product includes computer code for performing the operations of receiving a video stream at a first frame rate, downsampling the video stream to a second frame rate, upsampling the downsampled video stream to a third frame rate, and applying a voltage to a pixel element such that the pixel element transitions from a first pixel value to a predetermined second pixel value within a period of time consistent with the third frame rate. Computer readable medium is used for storing the computer code.

In another embodiment, a system for reducing fast motion artifacts in an LCD panel is described. The system includes an interface arranged to receive a video stream at a first frame rate, a downsampling unit coupled to the interface arranged to downsample the video stream to a second frame rate, an upsampling unit coupled to the downsampled unit arranged to upsample the downsampled video stream to a third frame rate, and a display controller unit coupled to the LCD panel and the upsampling unit arranged to apply a voltage to a pixel element such that the pixel element transitions from a first pixel value to a predetermined second pixel value within a period of time consistent with the third frame rate.

DESCRIPTION OF THE INVENTION

Reference will now be made in detail to a particular embodiment of the invention an example of which is illustrated in the accompanying drawings. While the invention will be described in conjunction with the particular embodiment, it will be understood that it is not intended to limit the invention to the described embodiment. To the contrary, it is intended to cover alternatives, modifications, and equivalents as may be included within the spirit and scope of the invention as defined by the appended claims.

Each pixel of an LCD panel can be directed to assume a luminance value discretized to the standard set [0, 1, 2, . . . , 255] where a triplet of such pixels provides the R, G, and B components that make up an arbitrary color which is updated each frame time, typically $1/60^{th}$ of a second. The problem with LCD pixels is that they respond sluggishly to an input command in that the pixels arrive at their target values only after several frames have elapsed, and the resulting display artifacts—"ghost" or blurred images of rapidly moving objects—are disconcerting. Ghosting occurs when the response speed of the LCD is not fast enough to keep up motion induced changes that must occur in coincidence with the frame rate. In the case of ghosting or blurring, the transition from one pixel value to another cannot be attained within the desired time frame since LCDs rely on the ability of the liquid crystal to orient itself under the influence of an electric field. Since the liquid crystal must physically move in order to change intensity, the viscous nature of the liquid crystal material itself contributes to the appearance of ghosting artifacts.

Figure 1:
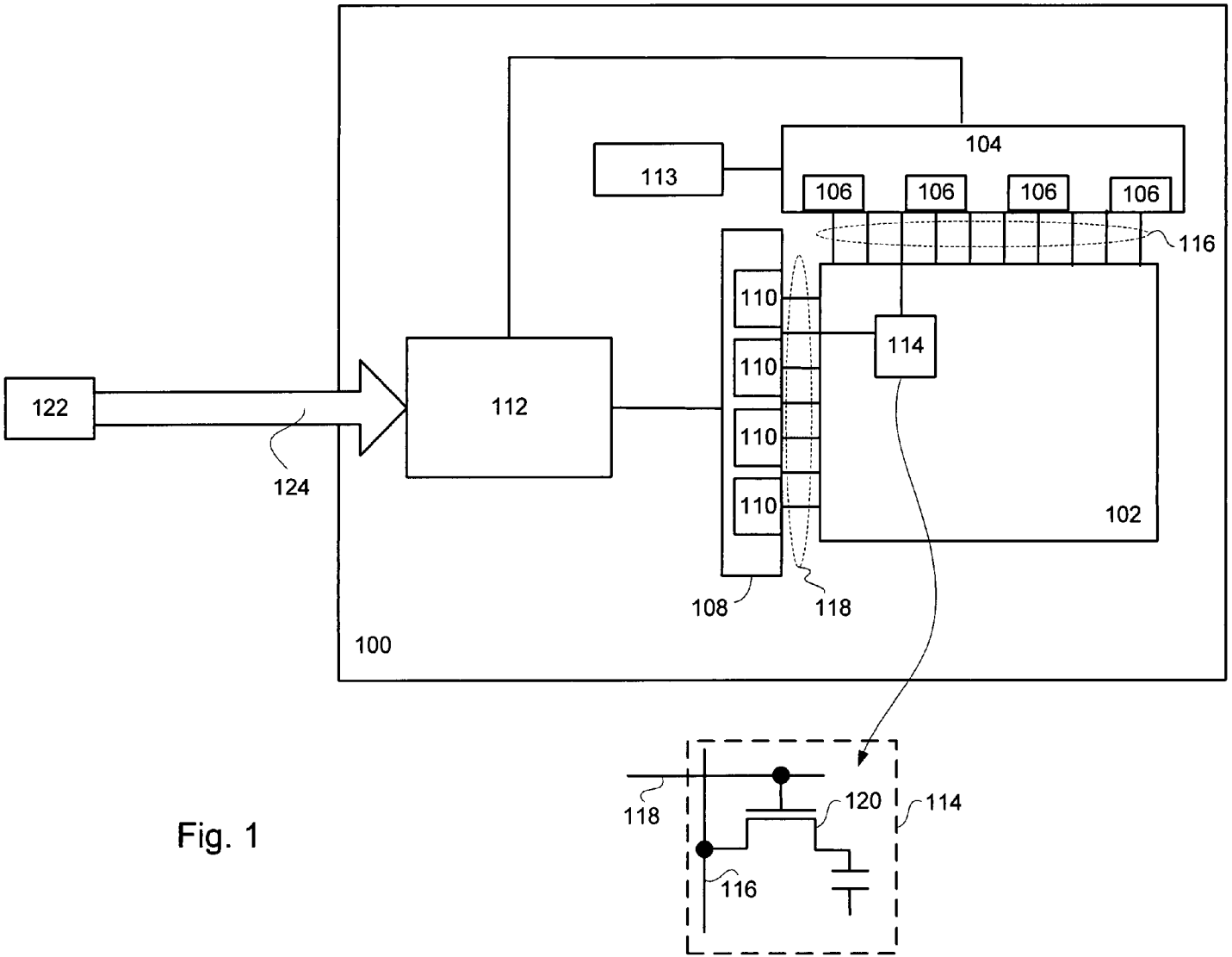
FIG. 1 is a block diagram showing an example of an active matrix liquid crystal display device 100 suitable for use with any embodiment of the invention.

What follows is a brief description of an active matrix LCD panel suitable for use with any embodiment of the invention. Accordingly, FIG. 1 is a block diagram showing an example of an active matrix liquid crystal display device 100 suitable for use with any embodiment of the invention. As shown in FIG. 1, the liquid crystal display device 100 is formed of a liquid crystal display panel 102, a data driver 104 that includes a number of data latches 106 suitable for storing image data, a gate driver 108 that includes gate driver logic circuits 110, a timing controller unit (also referred to as a TCON) 112, and a reference voltage power supply 113 that generates a reference voltage $V_{ref}$ that is applied to the liquid crystal display panel 102 as well as a number of predetermined voltages necessary for operations of the data driver 104 and the gate driver 108.

The LCD panel 102 includes a number of picture elements 114 that are arranged in a matrix connected to the data driver 104 by way of a plurality of data bus lines 116 and a plurality of gate bus lines 118. In the described embodiment, these picture elements take the form of a plurality of thin film transistors (TFTs) 120 that are connected between the data bus lines 116 and the gate bus lines 118. During operation, the data driver 104 outputs data signals (display data) to the data bus lines 116 while the gate driver 108 outputs a predetermined scanning signal to the gate bus lines 118 in sequence at timings which are in sync with a horizontal synchronizing signal. In this way, the TFTs 120 are turned ON when the predetermined scanning signal is supplied to the gate bus lines 118 to transmit the data signals, which are supplied to the data bus lines 116 and ultimately to selected ones of the picture elements 114.

Typically, the TCON 112 is connected to a video source 122 (such as a personal computer, TV or other such device) suitably arranged to output a video signal and, in most cases, an associated audio signal. (It should be noted that in the context of this discussion, the term video encompasses any grouping of associated images displayed on a display unit provided by a video source that can include, and not be limited to, computers, TVs, and the like.) The video signal can have any number and type of well-known formats, such as composite, serial digital, parallel digital, RGB, or consumer digital video. When the video signal takes the form of an analog video signal, then the video source 122 includes some form of an analog video source such as for example, an analog television, still camera, analog VCR, DVD player, camcorder, laser disk player, TV tuner, set top box (with satellite DSS or cable signal) and the like. In those cases where the video signal is a digital video signal, then the video source 122 includes a digital image source such as for example a digital television (DTV), digital still camera or video camera, and the like. The digital video signal can be any number and type of well known digital formats such as, SMPTE 274M-1995 (1920×1080 resolution, progressive or interlaced scan), SMPTE 296M-1997 (1280×720 resolution, progressive scan), as well as standard 480 progressive scan video.

Typically, the video signal provided by the video source 122 is taken to be a digital video signal consistent with what is referred to as RGB color space. As well known in the art, the video signals RGB are three digital signals (referred to as "RGB signal" hereinafter) formed of an "R" signal indicating a red luminance, a "G" signal indicating a green luminance, and a "B" signal indicating a blue luminance. The number of data bits associated with each constituent signal (referred to as the bit number) of the RGB signal is often set to 8 bit, for a total of 24 bits but, of course, can be any number of bits deemed appropriate.

For the remainder of this discussion, it will be assumed that the video signal provided by the video source 122 is digital in nature formed of a number of pixel data words each of which provides data for a particular pixel element. For this discussion, it will be assumed that each pixel data word includes 8 bits of data corresponding to a particular one of the color channels (i.e., Red, Blue, or Green).

Figure 2:
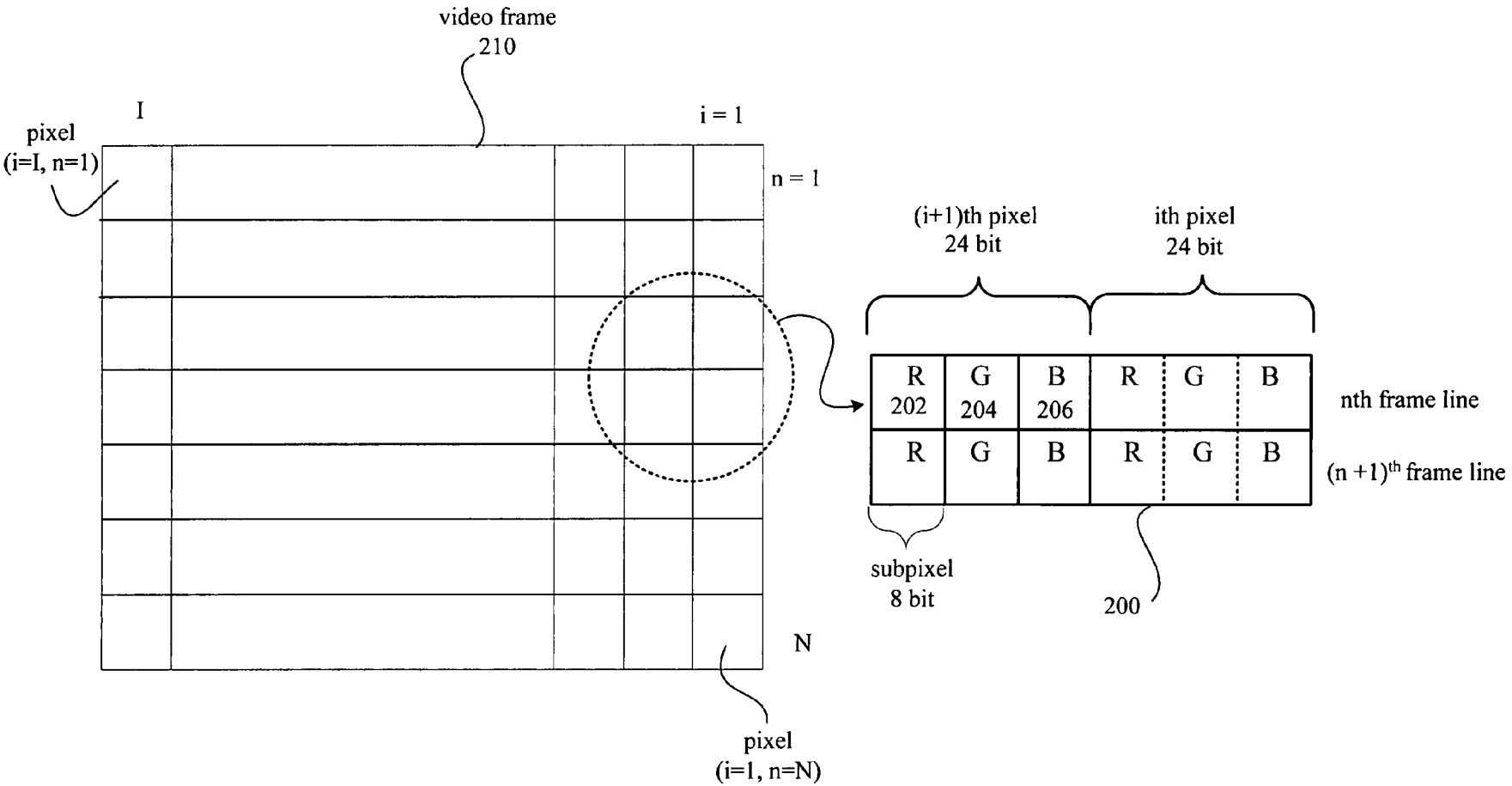
FIG. 2 shows a representative pixel data word 200 in accordance with the invention.

Accordingly, FIG. 2 shows a representative pixel data word 200 in accordance with the invention. The pixel data word 200 is shown suitable for an RGB based 24 bit (i.e., each color space component R, G, or B, is 8 bits) system. It should be noted, however, that although an RGB based system is used in the subsequent discussion, the invention is well suited for any appropriate color space. Accordingly, the pixel data word 200 is formed of 3 sub-pixels, a Red (R) sub-pixel 202, a Green (G) sub-pixel 204, and a Blue (B) sub-pixel 206 each sub-pixel being 8 bits long for a total of 24 bits. In this way, each sub-pixel is capable of generating $2^8$ (i.e., 256) voltage levels referred to hereinafter as pixel values. For example, the B sub-pixel 206 can be used to represent 256 levels of the color blue by varying the transparency of the liquid crystal which modulates the amount of light passing through an associated blue mask whereas the G sub-pixel 204 can be used to represent 256 levels of the color green in substantially the same manner. It is for this reason that display monitors are structured in such a way that each display pixel is formed of the 3 sub-pixels 202-206 which taken together form approximately 16 million displayable colors. Using an active matrix display, for example, a video frame 210 having N frame lines each of which is formed of I pixels, a particular pixel data word can be identified by denoting a frame line number n (from 1 to N) and a pixel number i (from 1 to I).

Referring back to FIG. 1, during the transmission of a video image in the form of a video frame, the video source 122 provides a data stream 124 formed of a number of pixel data words 200. The pixel data words 200 are then received and processed by the TCON 112 in such a way that all the video data (in the form of pixel data) used for the display of a particular frame line n of the video frame 210 must be provided to the data latches 106 within a line period τ. Therefore, once each data latch 106 has a corresponding pixel data stored therein which are selected in such a way to drive appropriate ones of the TFTs 120 in the LCD array 102.

In order to improve the performance of slow LCD panels, the performance of the LCD panel is first characterized by, for example, taking a series of measurements that show what each pixel will do by the end of one frame time. Such measurements are taken for a representative pixel (or pixels) each being initially at a starting pixel value s that is then commanded toward a target value t (where s and t each take on integer values from 0 to 255). If the pixel value actually attained in one frame time is p, then $$p=f_s(t) \tag{1}$$

where $f_s$ is the one-frame pixel-response function corresponding to a fixed start-pixel s. For example, the one-frame pixel response function $f_s(t)$ for a pixel having a start pixel value s=32 and a target pixel value t=192 that can only reach a pixel value p=100 is represented as $f_{32}(192)=100$.

For slow panels (where most if not all targets can not be reached within a frame time) functions m(s) and M(s) give the minimum pixel value and maximum pixel value, respectively, reachable in one frame time as functions of s where m(s) and M(s) define maximum-effort curves. Therefore, in order to reach a pixel value p that lies outside of the interval [m(s), M(s)], equation Error! Reference source not found. is solved for the argument that produces pixel value p that will achieve the goal (i.e., pixel value p) in one frame time. As well known in the art, when the value p is referred to as an overdrive pixel value indicating the voltage that would be necessary to drive the pixel from the start value s to the target value t in one frame period.

Figure 3A:
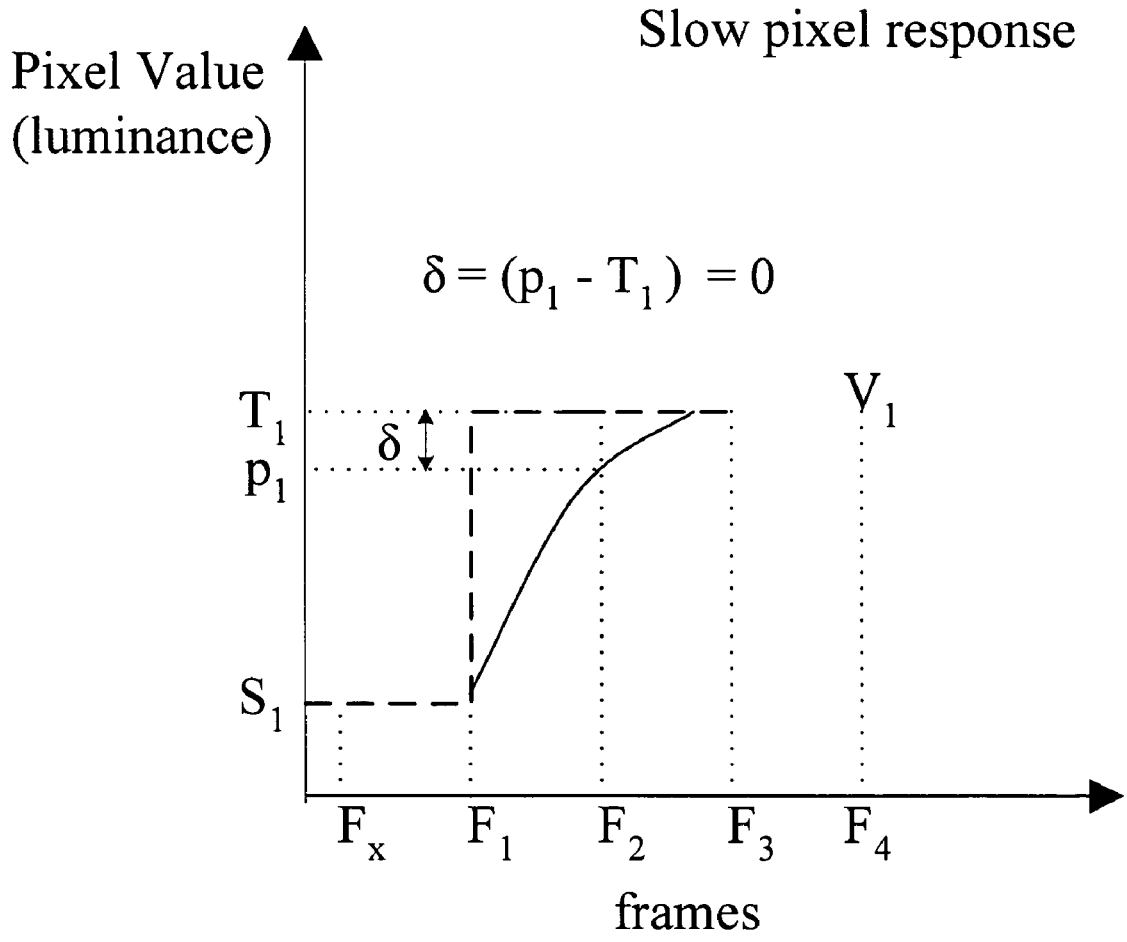
FIGS. 3A and 3B shows a pixel response curve for a slow pixel.
Figure 3B:
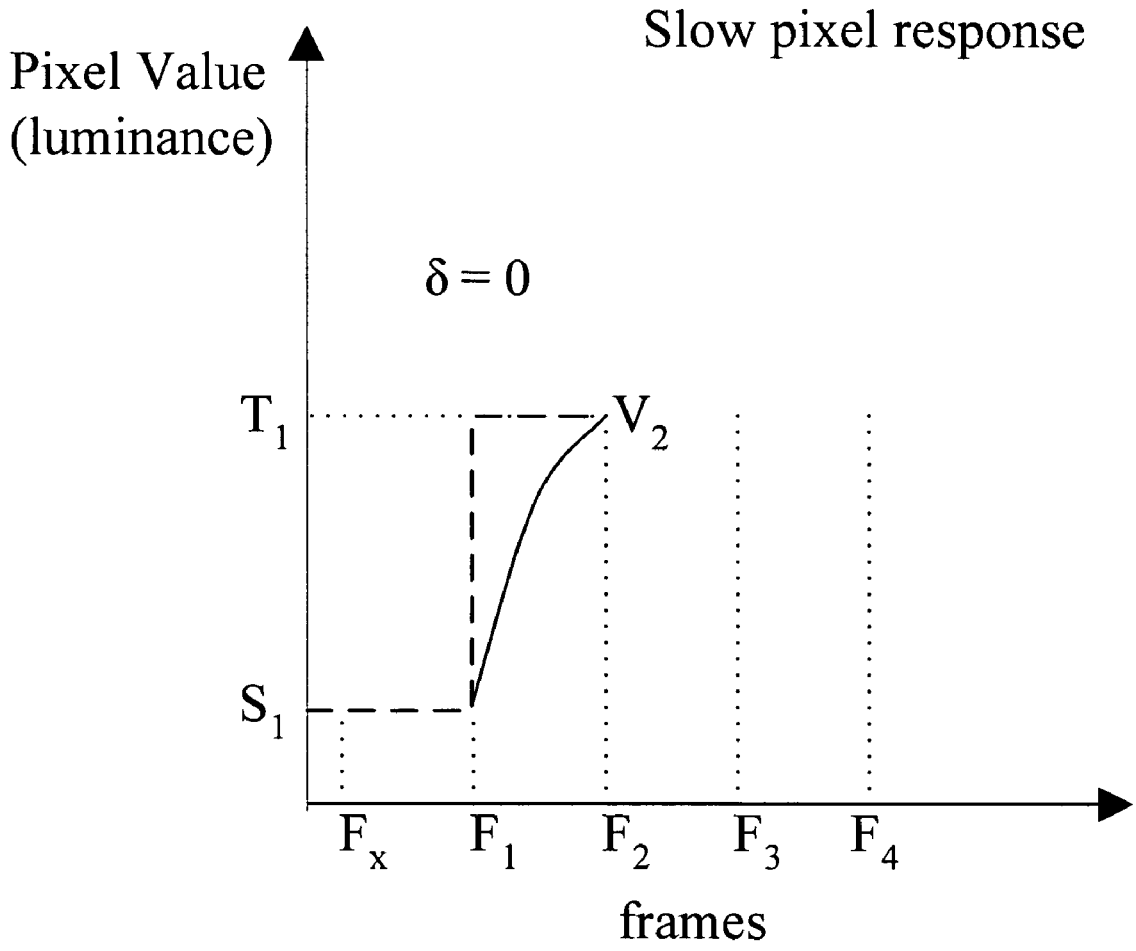

For example, FIG. 3A shows a pixel response curve for a slow pixel having a start pixel value $S_1$ at the beginning of a frame $F_1$ and a target pixel value $T_1$ (which may or may not be the start target pixel value of a next frame $F_2$) at the end the frame $F_1$. However, when the pixel is not overdriven (i.e., a voltage $V_1$ is applied consistent with the target pixel value $T_1$), the pixel value achieved $p_1$ falls short of the target pixel value $T_1$ by a value δ. However, when the pixel is overdriven (as in FIG. 3B) by applying a voltage $V_2>V_1$, the target pixel value $T_1$ is reached within the frame period $F_1$ thereby eliminating any ghosting artifacts in subsequent frames.

Even though pixel value overdrive technique are effective in reducing or eliminating motion induced artifacts such as blurring, they require a real-time calculation of the overdrive pixel value p for every pixel for every frame resulting in a substantial commitment to memory and processor resources. In contrast to the overdrive approach, the invention preserves the memory and processor resources while still providing substantial relief from fast motion artifacts without resorting to calculating pixel overdrive values for every video frame having such artifacts. In addition to reducing memory requirements, bandwidth is more efficiently utilized thereby increasing system throughput.

As discussed in more detail below, the invention mitigates the effects of slow pixel response by reducing motion artifacts (such as blurring) in LCD panels by modifying an incoming video frame rate such that the video motion delivered to the LCD panel is updated at a slower rate than that in the input video stream. In this way, the amount of time permitted for a pixel to transition from a starting pixel value to a target pixel value is increased to the point where the target pixel value is successfully achieved in the allotted period of time. In one embodiment, the input video stream is reduced by discarding frames either by subsampling at the video input or by dropping frames at the input. Subsequently, the reduced rate video stream is then upsampled to the desired output frame rate to the LCD panel by, for example, frame repetition or by any appropriate method of temporal frame interpolation. In this way, the amount of time allotted for a particular pixel to transition from a starting pixel value s to an associated target pixel value t is effectively doubled resulting in most, if not all, pixels successfully achieving their respective target pixel values. In this way, any motion artifacts related to slow pixel response time are effectively eliminated.

Figure 4A:
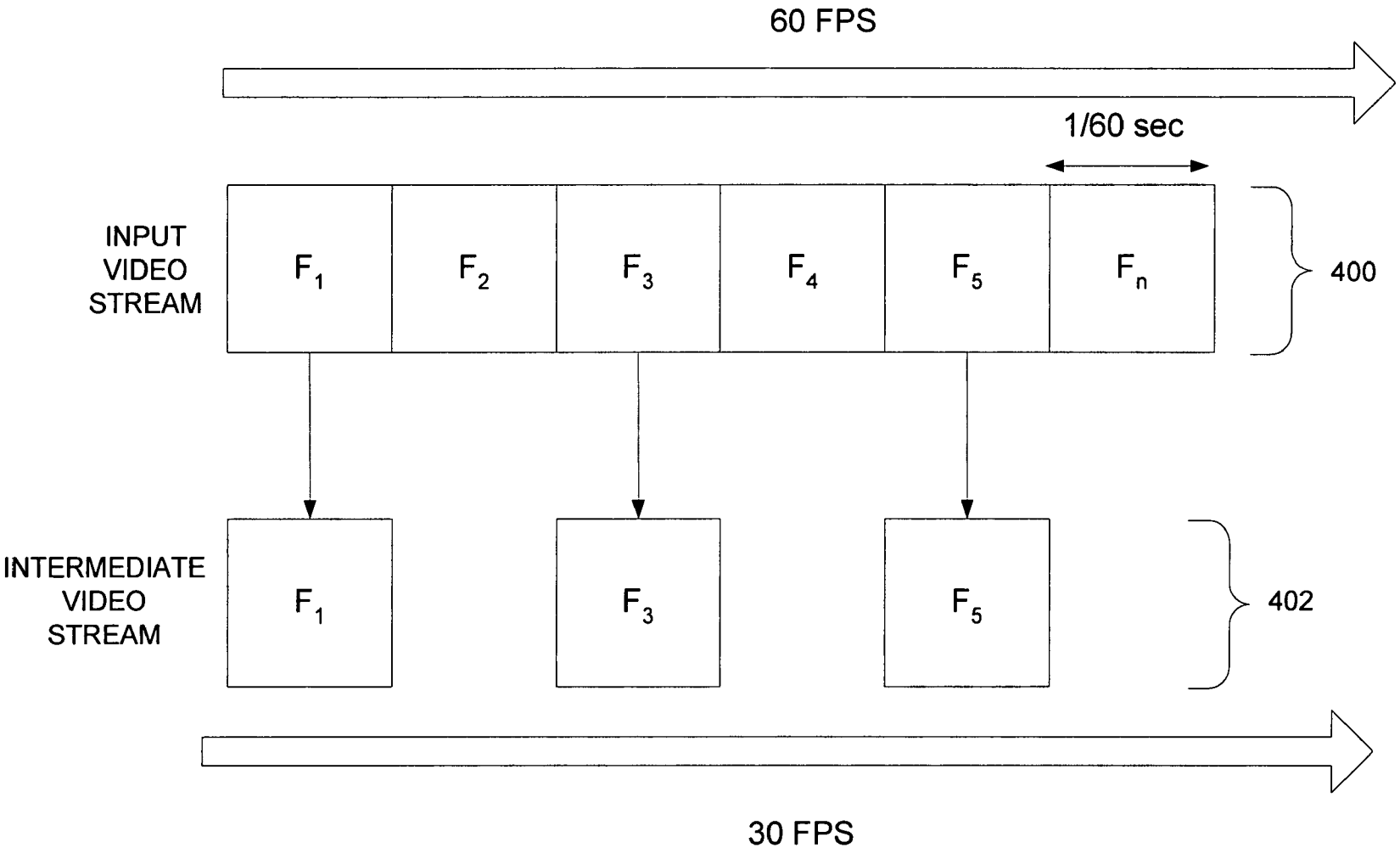
FIG. 4A shows an input video stream.

For example as shown in FIG. 4A, an input video stream 400 formed of a number of video frames $F_1$-$F_n$ has an incoming video frame rate $VFR_{in}$ of 60 frames per second (FPS). In this case, in order to avoid fast motion artifacts, a pixel P included in the LCD display panel 102 would have to be able to transition from a start pixel value $S_1$ to a target pixel value $T_1$ within a frame time of 1/60 seconds. However, by reducing the incoming video frame rate $VFR_{in}$ (by, for example, temporally subsampling or simply dropping frames from 60 FPS) down to 30 FPS of a subsampled video stream 402 which is then upsampled (as, for example, upsampled video stream 404), the period of time for the pixel P to transition from the starting pixel value $S_1$ to the target pixel value $T_1$ is effectively doubled since in order to provide a display image of 60 FPS, two video frames would then be presented to the LCD panel for each of the frames $F_1$, $F_3$, $F_5$, creating a 60 FPS output video stream 404 in which motion occurs only every two frames. In this way, the pixel P would have two frame periods (i.e., 2/60 seconds) to transition from the start pixel value $S_1$ to the target pixel value $T_1$.

Figure 4B:
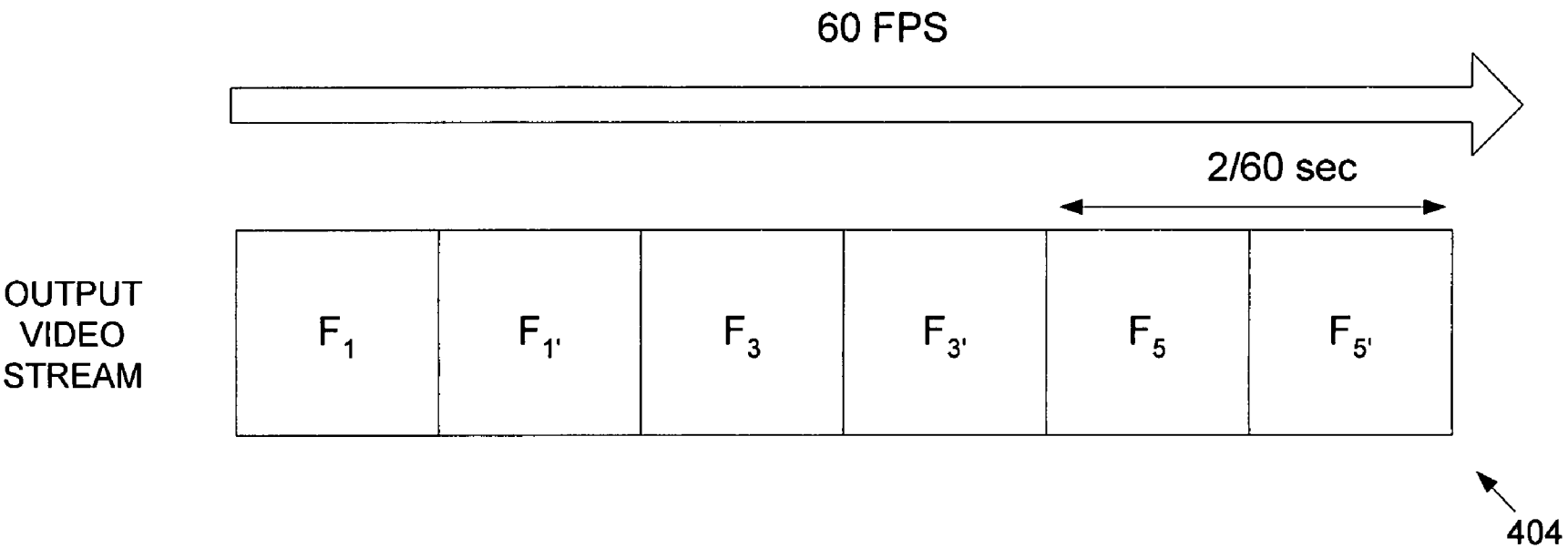
FIG. 4B shows an upsampled video stream in accordance with an embodiment of the invention.

In one embodiment, the upsampling can be based upon repeating frames (stored in a frame buffer, for example) as illustrated in FIG. 4B whereby a first video frame $F_{1'}$ (as a copy of the video frame $F_{1'}$) is inserted between the frames $F_1$ and $F_3$. In another embodiment, the interstitial frames (i.e., those used to upsample the video stream) are created by any manner of temporal interpolation based upon, for example, motion vectors derived from video frames $F_1$ and $F_3$, between $F_3$ and $F_5$, and so on.

Figure 5:
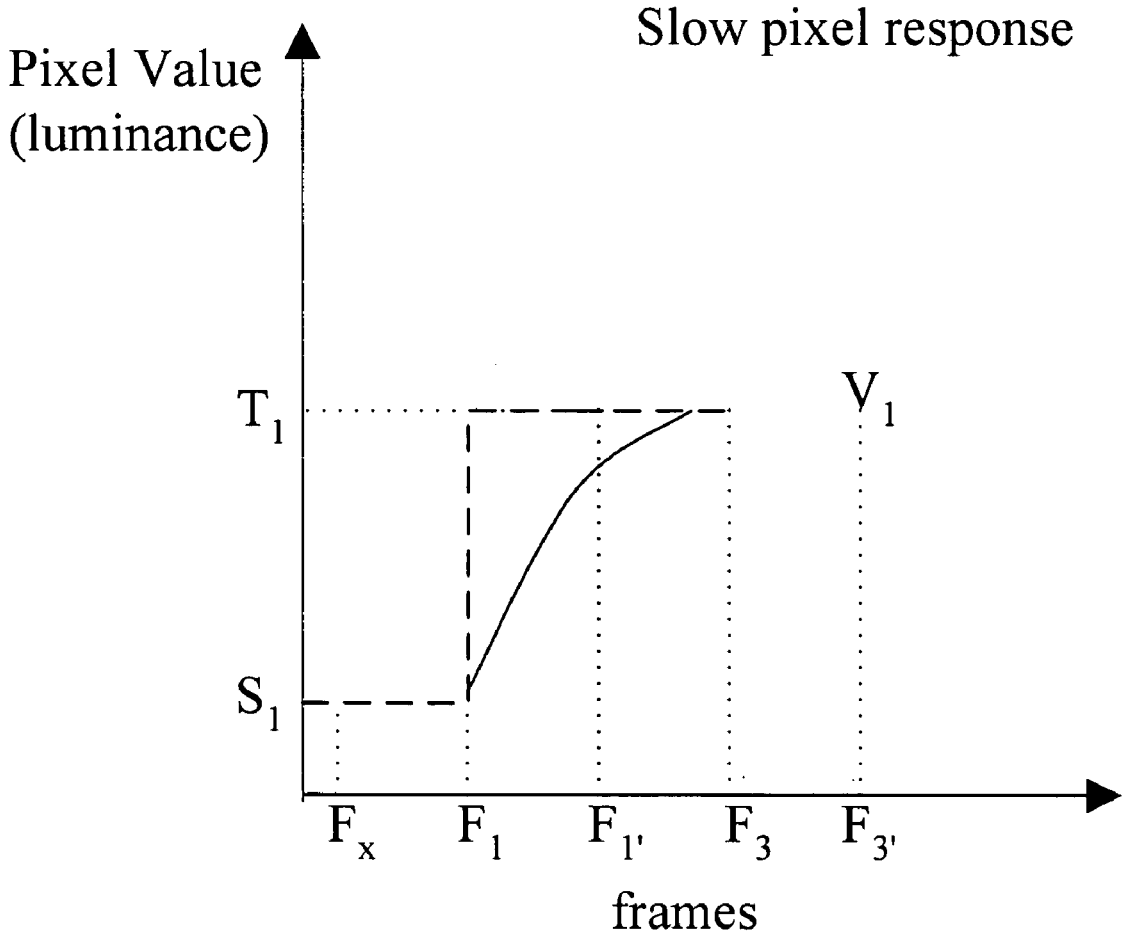
FIG. 5 shows an unoverdriven slow pixel P

The effect of this modification of the video frame rate is illustrated in FIG. 5 showing the unoverdriven slow pixel P (as previously shown in FIG. 3A) achieving the target pixel value $T_1$ during the frame $F_{1'}$ since by effectively doubling the frame period, the pixel P is now able to reach the target pixel value $T_1$. In this way, achieving the target pixel value T1 substantially eliminates the fast motion artifacts related to slow pixel response in subsequent video frames.

Figure 6:
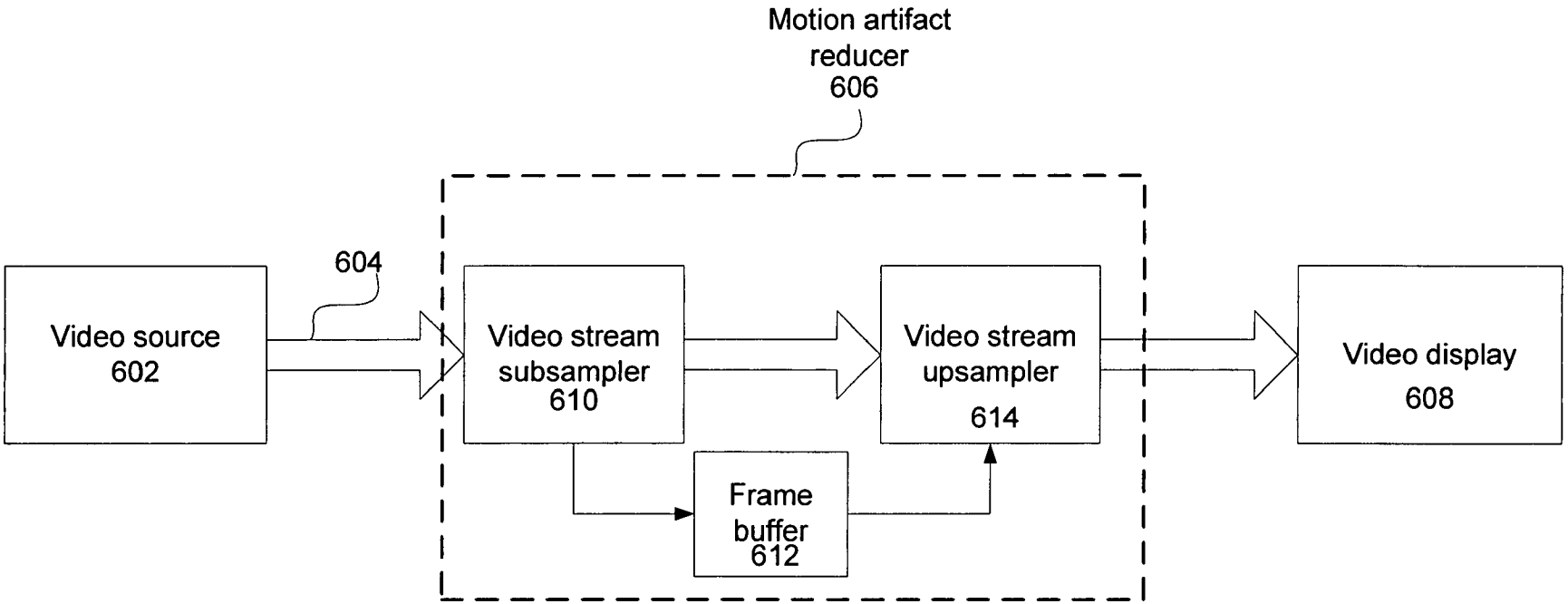
FIG. 6 illustrates a system employed to implement the invention.
Figure 7:
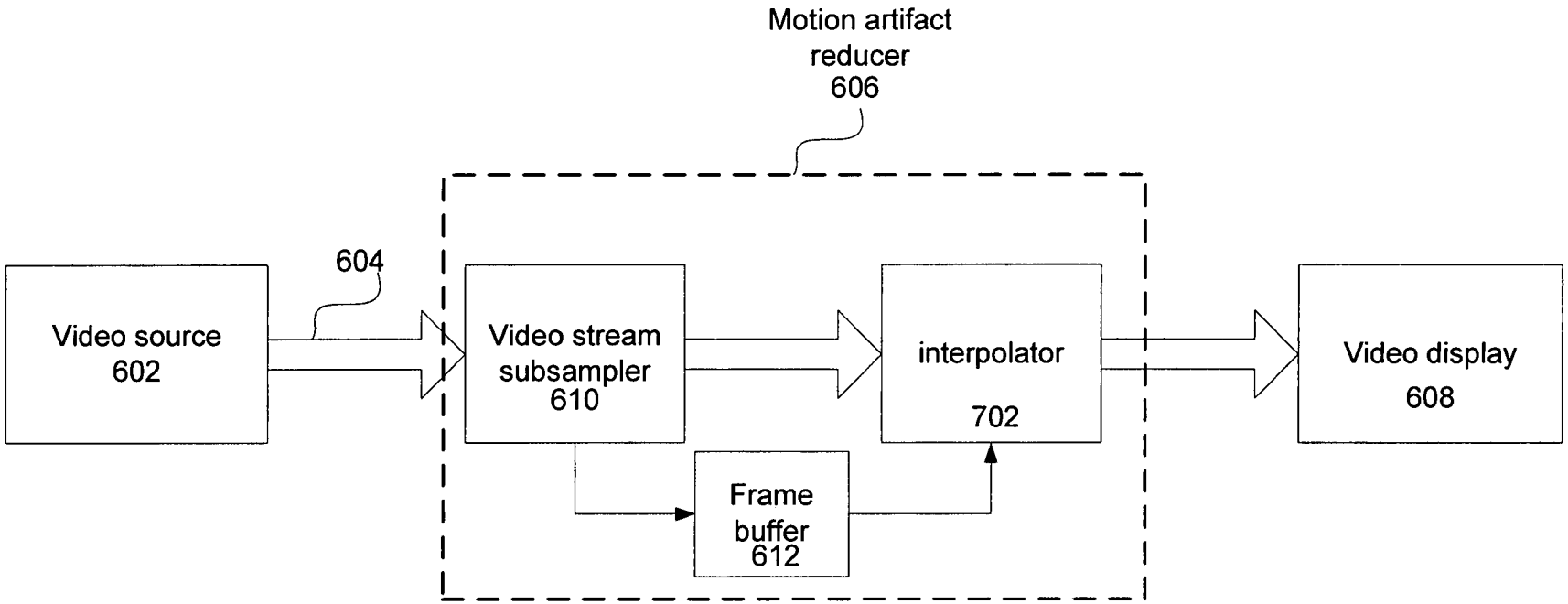
FIG. 7 illustrates another embodiment of the system shown in FIG. 6.

FIG. 6 shows an exemplary system 600 for implementing a particular embodiment of the invention. The system 600 includes a video source 602 arranged to generate a video stream 604 (along the lines of the video stream 122 or 400 described above) having an input video stream frame rate $VFR_{in}$. The video stream 604 is then passed to a motion artifact reducer unit 606 arranged to reduce the input video stream frame rate $VFR_{in}$ in order to provide ample time for any slow pixels to respond to fast motion changes and thereby reducing observable motion artifacts displayed on a video display unit 608 coupled thereto. In the described embodiment, the motion artifact reducer unit 606 includes a video stream subsampler 610 arranged to reduce the input video stream frame rate by any number of approaches. One such approach is based upon dropping specific video frames and copying the undropped video frames into a frame buffer 612. In this way, the stored video frames are then used by an upsampler unit 614, for example, coupled to the subsampler 610 to increase the frame rate back to one suitable for display on the display unit 608. In another embodiment shown in FIG. 7, the upsampler unit 614 takes the form of an interpolator unit 702 used to increase the outgoing video frame rate suitable for display on the display unit 608 by interpolation based upon, for example, motion vectors between various video frames.

Figure 8:
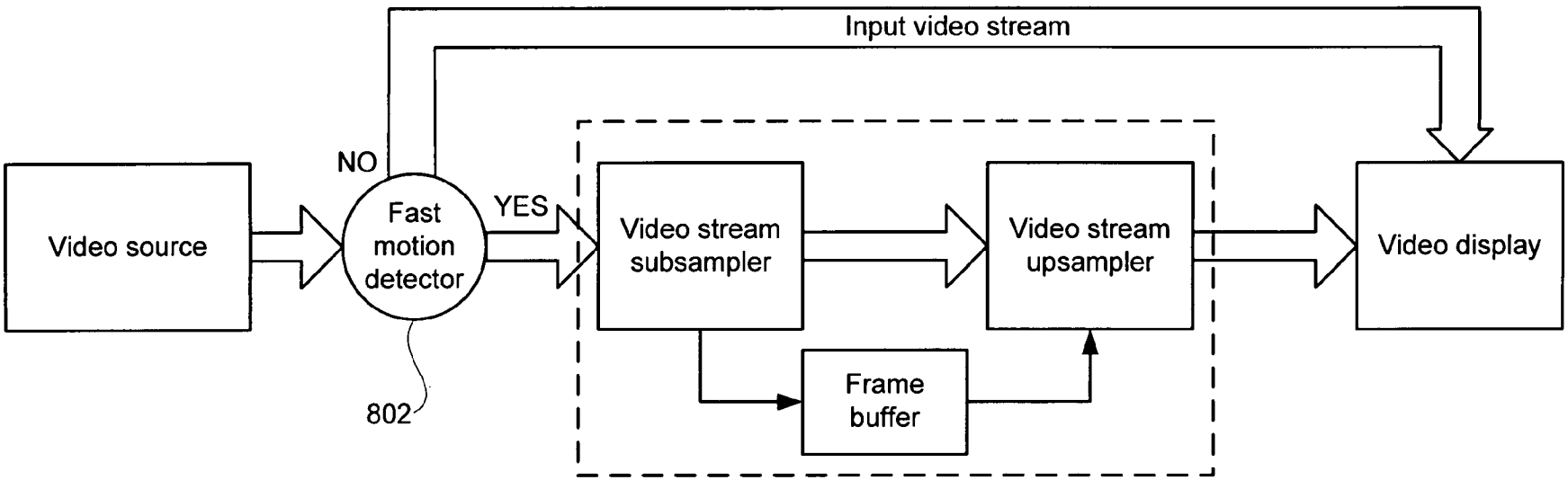
FIG. 8 shows another embodiment of the invention that incorporates a fast motion detector.

FIG. 8 shows another embodiment of the invention that incorporates a fast motion detection approach for identifying those frames that require fast motion compensation. In particular, a system 800 includes a fast motion detector unit 802 that can be structured, for example, along the lines described in co-pending U.S. patent application Ser. No. 10/874,849, "SELECTIVE USE OF LCD OVERDRIVE FOR REDUCING MOTION ARTIFACTS IN AN LCD DEVICE" by Wu et al filed Jun. 22, 2004 which is incorporated by reference in its entirety for all purposes. In this arrangement, the fast motion detector 802 limits the remedy for fast motion artifacts provided by the invention to mostly only those frames which have been identified as exhibiting the most likelihood of suffering from fast motion artifacts. In this way, any effects of reduced video frame rate and subsequent upsampling are limited in scope to only those frames so affected. This is especially well suited to those situations where many frames have large areas of static fields (such as backgrounds, sky, etc.).

Figure 9:
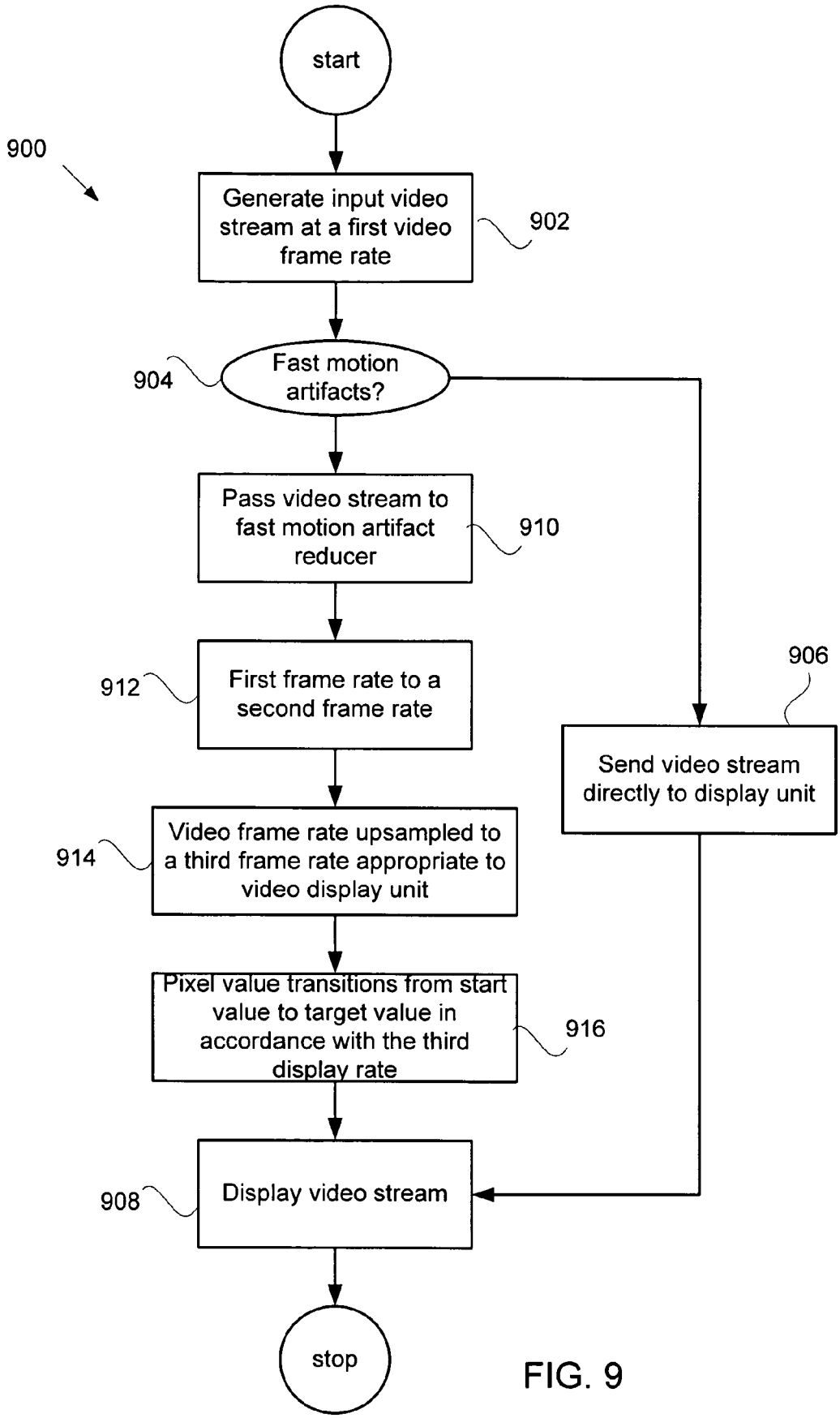
FIG. 9 shows a flowchart detailing a process 900 for mitigating the effects of fast motion in an LCD panel in accordance with an embodiment of the invention.

FIG. 9 shows a flowchart detailing a process 900 for mitigating the effects of fast motion in an LCD panel in accordance with an embodiment of the invention. At 902, an input video stream is generated having a first video stream frame rate. In a particular embodiment, a determination is made at 904 whether or not the input video stream, or portions thereof, have a high likelihood of producing fast motion display artifacts. In one implementation, the determination is based upon a comparison between adjacent or near adjacent video frames and based upon the comparison, the video stream (or portion thereof) subject to the determination is passed directly to the display at 906 for display at 908 or, in the alternative, passed to a motion artifact reducer unit at 910. In the case where the video stream, or portions thereof, is passed to the motion artifact reducer unit, the first video frame rate of the incoming video stream is converted to a second video frame rate at 912.

In some cases, the first video stream frame rate is reduced by dropping certain portions (such as individual video frames) of the video stream. The subsampled video stream at the second video frame rate is then upsampled at 914 to a third, outgoing video frame rate consistent with a video frame rate appropriate to the display. At 916, a pixel transitions from a start pixel value to a target pixel value in accordance with the third video frame rate which is then displayed on the display unit at 908.

In this way, the amount of time allowed for a slow pixel(s) to transition from a start pixel value s to a target pixel t is substantially increased. In so doing, the number of pixels unable to achieve the appropriate transition is effectively eliminated which in due course eliminated observable motion artifacts.

In general, the invention offers the advantage of allowing the liquid crystal more time to react to any change in pixel value. With more time before being updated to a new value, each pixel will come closer to the desired pixel value before the next increment of motion occurs. This increases the relative contrast between motion increments, and so reduces the LCD motion blue. Single pixel wide or high lines will reach a value much closer to their intended brightness.

Figure 10:
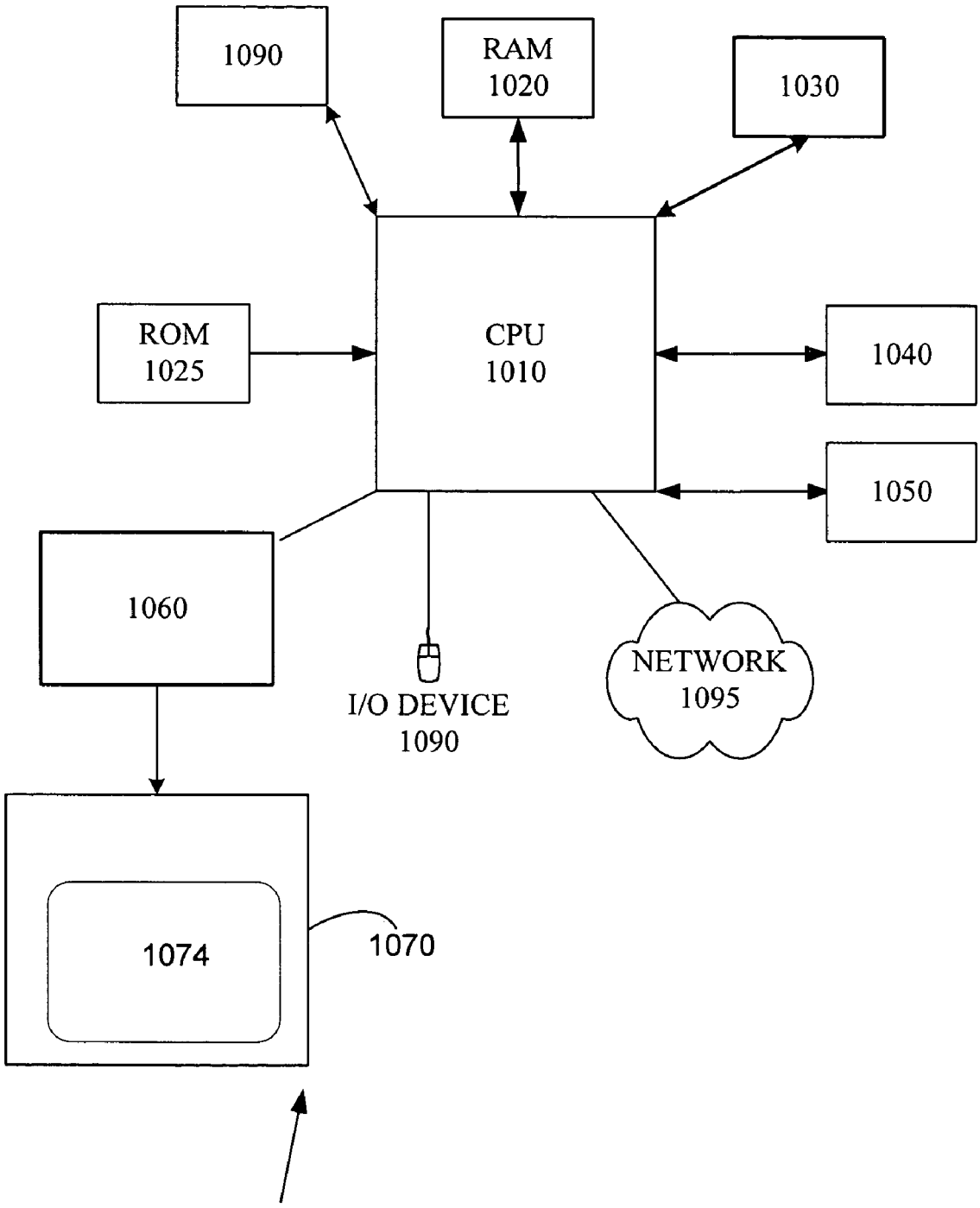
FIG. 10 illustrates a computing system employed to implement the invention

FIG. 10 illustrates a computing system 1000 employed to implement the invention. Computing system 1000 is only an example of a graphics system in which the present invention can be implemented. System 1000 includes central processing unit (CPU) 1010, random access memory (RAM) 1020, read only memory (ROM) 1025, one or more peripherals 1030, graphics controller 1060, primary storage devices 1040 and 1050, and digital display unit 1070. CPUs 1010 are also coupled to one or more input/output devices 1090 that may include, but are not limited to, devices such as, track balls, mice, keyboards, microphones, touch-sensitive displays, transducer card readers, magnetic or paper tape readers, tablets, styluses, voice or handwriting recognizers, or other well-known input devices such as, of course, other computers. Graphics controller 1060 generates image data and a corresponding reference signal, and provides both to digital display unit 1070. The image data can be generated, for example, based on pixel data received from CPU 1010 or from an external encode (not shown). In one embodiment, the image data is provided in RGB format and the reference signal includes the $V_{SYNC}$ and $H_{SYNC}$ signals well known in the art. However, it should be understood that the present invention can be implemented with image, data and/or reference signals in other formats. For example, image data can include video signal data also with a corresponding time reference signal.

Although only a few embodiments of the present invention have been described, it should be understood that the present invention may be embodied in many other specific forms without departing from the spirit or the scope of the present invention. The present examples are to be considered as illustrative and not restrictive, and the invention is not to be limited to the details given herein, but may be modified within the scope of the appended claims along with their full scope of equivalents.

While this invention has been described in terms of a preferred embodiment, there are alterations, permutations, and equivalents that fall within the scope of this invention. It should also be noted that there are many alternative ways of implementing both the process and apparatus of the present invention. It is therefore intended that the invention be interpreted as including all such alterations, permutations, and equivalents as fall within the true spirit and scope of the present invention.

We claim:

1. A method of reducing fast motion artifacts in an LCD panel, comprising:

receiving an input video stream at a first frame rate;

downsampling the input video stream to an intermediate video stream having a second frame rate that is less than the first frame rate;

upsampling the intermediate video stream to an output video stream at the first frame rate; and applying a voltage to a pixel element in the output video stream such that the pixel element transitions from a first pixel value to a predetermined second pixel value within a period of time consistent with the second frame rate.

2. A method as recited in claim 1, further comprising:

determining whether or not the input video stream is susceptible to fast motion display artifacts; and sending the input video stream directly to the LCD panel when it is determined that the video stream is not susceptible to fast motion artifacts.

3. A method as recited in claim 2, wherein the input video stream is formed of a number of video frames.

4. A method as recited in claim 3, wherein the downsampling comprises:

dropping selected ones of the video frames to form the intermediate video stream.

5. A method as recited in claim 4, further comprising:

storing a copy of the remaining video frames in a memory device.

6. A method as recited in claim 4, wherein the upsampling comprises;

retrieving the stored video frames from the memory device; and inserting the retrieved video frames back into the intermediate video stream where appropriate to form the output video stream.

7. A method as recited in claim 4, wherein the upsampling comprises:

creating an interpolated video frame based upon selected ones of the remaining video frames; and inserting the interpolated video frame back into the intermediate video stream where appropriate to form the output video stream.

8. A system for reducing fast motion artifacts in an LCD panel, comprising:

an interface arranged to receive an input video stream at a first frame rate;

a downsampling unit coupled to the interface arranged to downsample the video stream to an intermediate video stream at a second frame rate that is slower than the first frame rate;

an upsampling unit coupled to the downsampled unit arranged to upsample the downsampled video stream to an output video stream at the first frame rate; and a display controller unit coupled to the LCD panel and the upsampling unit arranged to apply a voltage to a pixel element such that the pixel element transitions from a first pixel value to a predetermined second pixel value within a period of time consistent with the second frame rate.

9. A system as recited in claim 8, further comprising:

a video bypass switch arranged to send the video stream directly to the LCD panel when it is determined that the input video stream is not susceptible to fast motion artifacts.

10. A system as recited in claim 8, wherein the input video stream is formed of a number of video frames.

11. A system as recited in claim 8, wherein the downsampling unit comprises:

a video frame dropper unit arranged to drop selected ones of the video frames from the input video stream to form the intermediate video stream.

12. A system as recited in claim 11, further comprising:

a memory device for storing a copy of the remaining video frames.

13. A system as recited in claim 12, wherein the upsampling unit comprises;

a memory controller for retrieving the stored video frames from the memory device and inserting the retrieved video frames back into the intermediate video stream where appropriate to form the output video stream.

14. A system as recited in claim 12, wherein the up sampling unit comprises:

an interpolator unit for creating an interpolated video frame based upon selected ones of the remaining video frames and inserting the interpolated video frame back into the intermediate video stream where appropriate to form the output video stream.

15. A method of reducing fast motion artifacts in an LCD panel, comprising:

receiving an input video stream at a first frame rate;

downsampling the input video stream to an intermediate video stream having a second frame rate that is less than the first frame rate;

upsampling the intermediate video stream to an output video stream at the first frame rate; and applying a voltage to a pixel element in the output video stream such that the pixel element transitions from a first pixel value to a predetermined second pixel value within a period of time consistent with the third second frame rate determining whether or not the input video stream is susceptible to fast motion display artifacts; and sending the input video stream directly to the LCD panel when it is determined that the video stream is not susceptible to fast motion artifacts.

16. A method as recited in claim 15, wherein the input video stream is formed of a number of video frames.

17. A method as recited in claim 16, wherein the downsampling comprises:

dropping selected ones of the video frames to form the intermediate video stream.

18. A method as recited in claim 17, further comprising:

storing a copy of the remaining video frames in a memory device.

19. A method as recited in claim 18, wherein the upsampling comprises;

retrieving the stored video frames from the memory device; and inserting the retrieved video frames back into the intermediate video stream where appropriate to form the output video stream.

20. A method as recited in claim 19, wherein the up sampling comprises:

creating an interpolated video frame based upon selected ones of the remaining video frames; and inserting the interpolated video frame back into the intermediate video stream where appropriate to form the output video stream.

21. A method comprising:

determining whether or not an input video stream is susceptible to fast motion display artifacts;

sending the input video stream directly to an LCD panel when it is determined that the video stream is not susceptible to fast motion artifacts;

wherein if it is determined that the input video stream is susceptible to fast motion display artifacts, then receiving an input video stream at a first frame rate;

downsampling the input video stream to an intermediate video stream having a second frame rate that is less than the first frame rate;

upsampling the intermediate video stream to an output video stream at the first frame rate; and applying a voltage to a pixel element in the output video stream such that the pixel element transitions from a first pixel value to a predetermined second pixel value within a period of time consistent with the second frame rate.

22. A method as recited in claim 21, wherein the downsampling comprises:

dropping selected ones of the video frames to form the intermediate video stream.

23. A method as recited in claim 22, further comprising:

storing a copy of the remaining video frames in a memory device.

24. A method as recited in claim 23, wherein the upsampling comprises;

retrieving the stored video frames from the memory device; and inserting the retrieved video frames back into the intermediate video stream where appropriate to form the output video stream.

25. A method as recited in claim 23, wherein the upsampling comprises:

creating an interpolated video frame based upon selected ones of the remaining video frames; and inserting the interpolated video frame back into the intermediate video stream where appropriate to form the output video stream.

26. A processor coupled to an LCD panel, wherein the processor reduces fast motion artifacts in the LCD panel, the processor comprising:

an interface for receiving an input video stream at a first frame rate;

a downsampling module for downsampling the input video stream to an intermediate video stream having a second frame rate that is less than the first frame rate;

an upsampling module for upsampling the intermediate video stream to an output video stream at the first frame rate; and an display module for applying a voltage to a pixel element in the output video stream such that the pixel element transitions from a first pixel value to a predetermined second pixel value within a period of time consistent with the second frame rate.

27. A processor as recited in claim 26, wherein the interface determines whether or not the input video stream is susceptible to fast motion display artifacts, and sends the input video stream directly to the LCD panel when it is determined that the video stream is not susceptible to fast motion artifacts.

28. A processor as recited in claim 27, wherein the input video stream is formed of a number of video frames.

29. A processor as recited in claim 28, wherein the downsampling module downsamples the input video stream by dropping selected ones of the video frames to form the intermediate video stream.

30. A processor as recited in claim 29, wherein a copy of the remaining video frames are stored in a memory device coupled to the processor.

31. A processor as recited in claim 30, wherein the upsampling module upsamples the video stream by retrieving the stored video frames from the memory device, and inserting the retrieved video frames back into the intermediate video stream where appropriate to form the output video stream.

32. A processor as recited in claim 30, wherein the upsampling module upsamples the video stream by creating an interpolated video frame based upon selected ones of the remaining video frames, and inserting the interpolated video frame back into the intermediate video stream where appropriate to form the output video stream.

* * * * *

UNITED STATES PATENT AND TRADEMARK OFFICE

CERTIFICATE OF CORRECTION

PATENT NO. : 7,495,647 B2
APPLICATION NO. : 11/021635
DATED : December 22, 2004
INVENTOR(S) : Tryhub et al.

It is certified that error appears in the above-identified patent and that said Letters Patent is hereby corrected as shown below:

Title Page
Item (60) Related U.S. Application Data:

Change "Provisional application No. 60/759,954, filed on Jun. 14, 2004, provisional application No. 60/527,423, filed on Dec. 8, 2003, provisional application No. 60/527,543, filed on Dec. 5, 2003, provisional application No. 60/527,437, filed on Dec. 5, 2003."

to --Provisional application No. 60/759,954, filed on Jun. 14, 2004.--

Col. 1, lines 4-20, change "RELATED APPLICATIONS
This application takes priority under 35 U.S.C. 119(e) to (i) U.S. Provisional Patent Application No. 60/579,954, filed on Jun. 14, 2004 entitled "LCD BLUR REDUCTION THROUGH FRAME RATE CONTROL" by Tryhub et al, (ii) U.S. Provisional Patent Application No.: 60/527,423, filed on Dec. 8, 2003 entitled "LCD OVERDRIVE AUTOCALIBRATION" by Selby, (iii) U.S. Provisional Patent Application No.: 60/527,543, filed on Dec. 5, 2003 entitled "METHOD OF IMPROVING FIXED PIXEL DISPLAY RESPONSE TIME" by Selby, and (iv) U.S. Provisional Patent Application No.: 60/527,437, filed on Dec. 5, 2003 entitled "METHOD AND APPARATUS FOR ENHANCING THE APPEARANCE OF MOTION ON AN LCD PANEL" by Selby, each of which are incorporated by reference in its entirety."

to --RELATED APPLICATION
This application claims priority to Provisional Patent Application No. 60/579,954, filed on Jun. 14, 2004 entitled "LCD BLUR REDUCTION THROUGH FRAME RATE CONTROL" by Tryhub et al., which is incorporated by reference in its entirety.--

Signed and Sealed this

Ninth Day of February, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,495,647 B2
APPLICATION NO. : 11/021635
DATED : February 24, 2009
INVENTOR(S) : Tryhub et al.

It is certified that error appears in the above-identified patent and that said Letters Patent is hereby corrected as shown below:

Title Page
Item (60) Related U.S. Application Data:

Change "Provisional application No. 60/759,954, filed on Jun. 14, 2004, provisional application No. 60/527,423, filed on Dec. 8, 2003, provisional application No. 60/527,543, filed on Dec. 5, 2003, provisional application No. 60/527,437, filed on Dec. 5, 2003."

to --Provisional application No. 60/759,954, filed on Jun. 14, 2004.--

Col. 1, lines 4-20, change "RELATED APPLICATIONS
This application takes priority under 35 U.S.C. 119(e) to (i) U.S. Provisional Patent Application No. 60/579,954, filed on Jun. 14, 2004 entitled "LCD BLUR REDUCTION THROUGH FRAME RATE CONTROL" by Tryhub et al, (ii) U.S. Provisional Patent Application No.: 60/527,423, filed on Dec. 8, 2003 entitled "LCD OVERDRIVE AUTOCALIBRATION" by Selby, (iii) U.S. Provisional Patent Application No.: 60/527,543, filed on Dec. 5, 2003 entitled "METHOD OF IMPROVING FIXED PIXEL DISPLAY RESPONSE TIME" by Selby, and (iv) U.S. Provisional Patent Application No.: 60/527,437, filed on Dec. 5, 2003 entitled "METHOD AND APPARATUS FOR ENHANCING THE APPEARANCE OF MOTION ON AN LCD PANEL" by Selby, each of which are incorporated by reference in its entirety."

to --RELATED APPLICATION
This application claims priority to Provisional Patent Application No. 60/579,954, filed on Jun. 14, 2004 entitled "LCD BLUR REDUCTION THROUGH FRAME RATE CONTROL" by Tryhub et al., which is incorporated by reference in its entirety.--

This certificate supersedes the Certificate of Correction issued February 9, 2010.

Signed and Sealed this

Thirtieth Day of March, 2010

David J. Kappos

David J. Kappos
*Director of the United States Patent and Trademark Office*